US008596241B2

(12) United States Patent
Ashizawa

(10) Patent No.: US 8,596,241 B2
(45) Date of Patent: Dec. 3, 2013

(54) INTERNAL COMBUSTION ENGINE

(75) Inventor: Takeshi Ashizawa, Yokohama (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 13/501,926

(22) PCT Filed: Nov. 25, 2010

(86) PCT No.: PCT/JP2010/071533

§ 371 (c)(1),
(2), (4) Date: Apr. 13, 2012

(87) PCT Pub. No.: WO2012/070159

PCT Pub. Date: May 31, 2012

(65) Prior Publication Data

US 2012/0199098 A1 Aug. 9, 2012

(51) Int. Cl.
*F02B 19/16* (2006.01)

(52) U.S. Cl.
USPC ..... 123/285; 123/253

(58) Field of Classification Search
USPC ..... 123/48 D, 253, 258–260, 264, 268, 269, 123/273–275, 279, 281, 285, 292
See application file for complete search history.

(56) References Cited

U.S. PATENT DOCUMENTS

| | | | | |
|---|---|---|---|---|
| 1,415,025 | A | 5/1922 | Folsom | |
| 2,500,409 | A | 3/1950 | Hawkins | |
| 4,041,909 | A * | 8/1977 | Nakamura | 123/268 |
| 6,119,650 | A * | 9/2000 | Tanigawa et al. | 123/268 |
| 2006/0219210 | A1 * | 10/2006 | Bailey et al. | 123/259 |
| 2012/0160217 | A1 * | 6/2012 | Ashizawa | 123/48 D |
| 2012/0304949 | A1 * | 12/2012 | Ashizawa | 123/142.5 R |

FOREIGN PATENT DOCUMENTS

| | | |
|---|---|---|
| DE | 688655 | 2/1940 |
| DE | 25 37 221 | 3/1977 |
| JP | 09-158728 A | 6/1997 |
| JP | 2000-230439 A | 8/2000 |
| JP | 2007-303448 A | 11/2007 |

OTHER PUBLICATIONS

Office Action issued in corresponding German Patent Application No. 11 2010 005 781.8 dated May 17, 2013.

* cited by examiner

*Primary Examiner* — John Kwon
*Assistant Examiner* — Johnny Hoang
(74) *Attorney, Agent, or Firm* — Sughrue Mion, PLLC

(57) ABSTRACT

An internal combustion engine is provided with a sub chamber which is communicated with a combustion chamber and with a variable volume device which changes the volume of the sub chamber. The variable volume device includes a communication part arranged at a cylinder head and formed into a tubular shape, a movement member which is formed in a tubular shape so as to engage with the inside of the communication part and which has a closed end at the side facing the combustion chamber, and a support part which has a projecting part which engages with the inside of the movement member. The variable volume device has the space at the inside of the communication part divided by a movement member and is formed with a sub chamber and gas chamber. The movement member has an open end at the opposite side to the side facing the combustion chamber and is formed so that gas in the gas chamber which leaks from the parts where the movement member and the projecting part contact is discharged to the outside of the cylinder head.

3 Claims, 4 Drawing Sheets

INTERNAL COMBUSTION ENGINE

CROSS REFERENCE TO RELATED APPLICATIONS

This application is a National Stage of International Application No. PCT/JP2010/071533 filed Nov. 25, 2010, the contents of all of which are incorporated herein by reference in their entirety.

TECHNICAL FIELD

The present invention relates to an internal combustion engine.

BACKGROUND ART

An internal combustion engine supplies a combustion chamber with fuel and air and burns the fuel in the combustion chamber to output a drive force. When burning fuel in the combustion chamber, the air-fuel mixture of the air and fuel is compressed in state. It is known that the compression ratio of the internal combustion engine has an effect on the output and fuel consumption. By raising the compression ratio, it is possible to increase the output torque or reduce the fuel consumption. On the other hand, if making the compression ratio extremely high, it is known that knocking or other abnormal combustion occurs.

Japanese Patent Publication (A) No. 2000-230439 discloses a self-ignition type internal combustion engine which provides a combustion chamber with a sub chamber which is communicated through a pressure regulator, wherein the pressure regulator has a valve element and a valve shaft which is connected to the valve element and is biased to the combustion chamber side. It is disclosed that this self igniting type internal combustion engine pushes up the pressure regulator against the pressure of an elastic member and releases the pressure to the sub chamber when overly early ignition etc. causes the combustion pressure to exceed a predetermined allowable pressure value. This publication discloses a pressure regulator which operates by a pressure larger than the pressure which occurs due to overly early ignition etc. Further, in this publication, an internal combustion engine is disclosed where a sub chamber is formed which communicates with the combustion chamber and a sub piston is inserted able to move vertically in the sub chamber. The sub piston is pressed against by a mechanical spring. It is disclosed that when the fuel is burned, the pressure of the combustion chamber causes the mechanical spring to be compressed and the sub piston to rise and the volume of the sub chamber which communicates with the combustion chamber becomes larger.

CITATION LIST

Patent Literature

PLT 1: Japanese Patent Publication (A) No. 2000-230439

SUMMARY OF INVENTION

Technical Problem

In a device controlling the pressure of a combustion chamber when fuel is burned, as the member which is compressed when the pressure of the combustion chamber rises, as disclosed in the above Japanese Patent Publication (A) No. 2000-230439, it is possible to employ a mechanical spring. Further, in addition to a mechanical spring, it is possible to employ a gas spring in which a gas is charged. A gas spring can easily handle the high pressure of a combustion chamber by an increase of the inside gas pressure. That is, by employing the gas spring, it is possible to easily strengthen the elasticity.

In this regard, when employing a gas spring as a member which is compressed when the pressure of a combustion chamber rises, there was the problem that the gas sealed in the gas spring would leak out and flow into the combustion chamber. The gas spring is charged with high pressure gas in order to handle the pressure when the fuel is burned in the combustion chamber. For this reason, sometimes gas leaks from the gas spring and flows into the combustion chamber.

If the gas which is charged into gas springs leaks to the combustion chambers, sometimes there is a detrimental effect on the operating state of the internal combustion engine. For example, the torque which is output with each combustion cycle will fluctuate, the torque which is output between the plurality of cylinders will fluctuate, and, further, the air-fuel ratio at the time of combustion will deviate from the desired value resulting in the properties of the exhaust which is discharged into the atmosphere deteriorating.

The present invention has as its object the provision of an internal combustion engine which is provided with a device for controlling the pressure of a combustion chamber including a gas spring and which keeps gas which is charged into a gas spring from being leaked to a combustion chamber.

Solution to Problem

An internal combustion engine of the present invention is provided with a sub chamber which is communicated with a combustion chamber and a variable volume device which changes a volume of the sub chamber. The variable volume device includes a communication part arranged at a cylinder head including a crown face of the combustion chamber and formed into a tubular shape so as to communicate with the combustion chamber, a movement member which is formed in a tubular shape so as to engage with the inside of the communication part and which has a closed end at the side facing the combustion chamber, and a support part which has a projecting part which engages with the inside of the movement member and which supports the movement member in a movable manner. The variable volume device is divided by the movement member at the space at the inside of the communication part whereby a sub chamber is formed at the side facing the combustion chamber and a sealable gas chamber is formed at the opposite side to the side facing the combustion chamber. The variable volume device is formed so that when the pressure of the combustion chamber reaches a control pressure, the change in pressure of the combustion chamber is used as a drive source so that the movement member moves and thereby the volume of the sub chamber becomes larger. The movement member has an open end at the opposite side to the side facing the combustion chamber and discharges gas of the gas chamber which leaks from the parts where the movement member and the projecting part contact to the outside of the cylinder head.

In the above invention, the variable volume device includes a first sealing member which is arranged between the communication part and the movement member and a second sealing member which is arranged between the movement member and the projecting part, the second sealing member formed to have a higher sealing ability than the first sealing member.

In the above invention, the variable volume device includes a first sealing member which is arranged between the communication part and the movement member and a second sealing member which is arranged between the movement member and the projecting part, the first sealing member formed to have a higher heat resistance than the second sealing member.

Advantageous Effects of Invention

According to the present invention, it is possible to provide an internal combustion engine which is provided with a device which includes a gas spring and controls the pressure of a combustion chamber and which keeps gas charged in a gas spring from leaking to a combustion chamber.

DESCRIPTION OF EMBODIMENTS

Referring to FIG. 1 to FIG. 4, an internal combustion engine in an embodiment will be explained. In the present embodiment, the explanation will be given with reference to the example of an internal combustion engine which is mounted in a vehicle.

Figure 1:
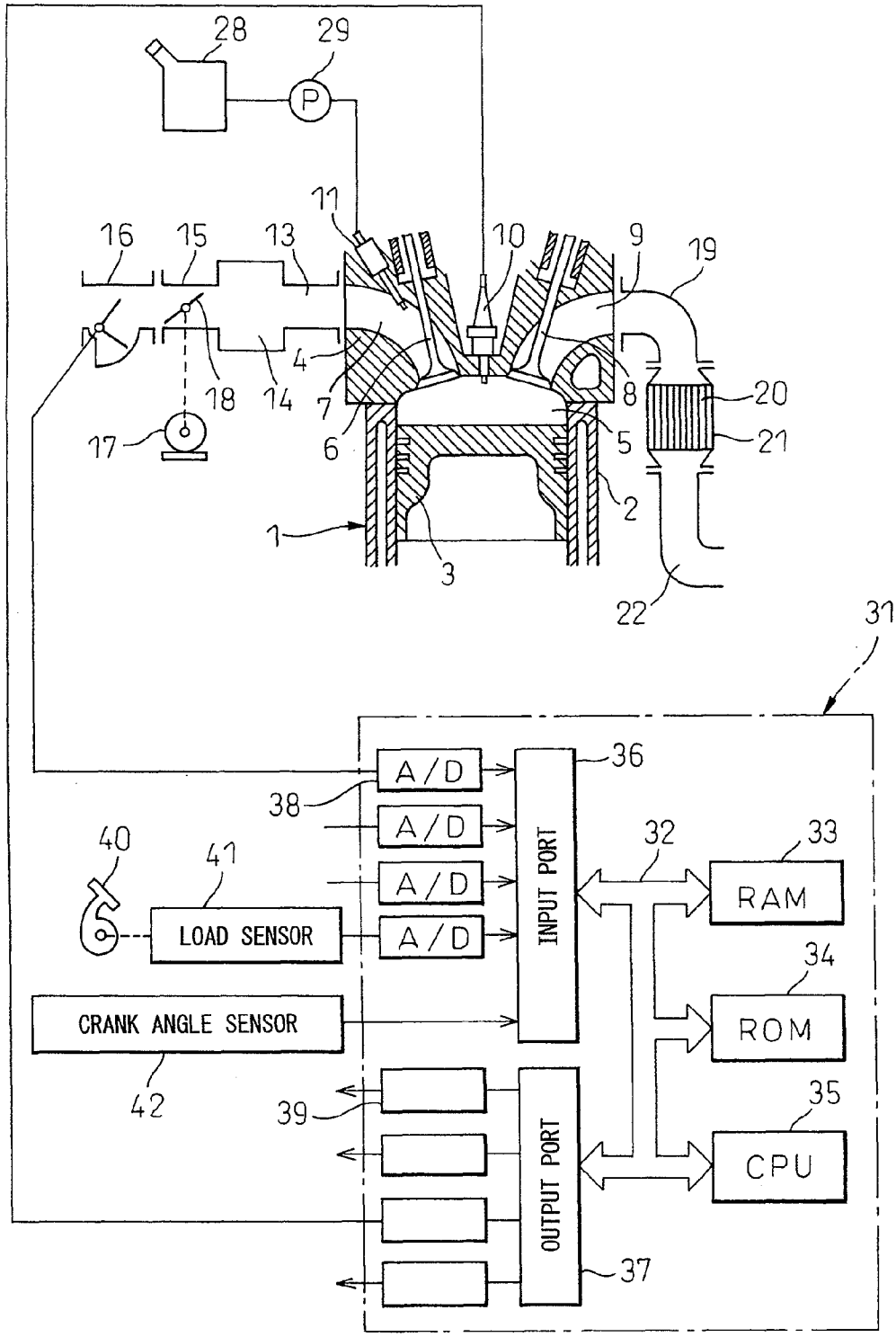
FIG. 1 is a schematic view of an internal combustion engine in an embodiment.

FIG. 1 is a schematic view of an internal combustion engine in the present embodiment. The internal combustion engine in the present embodiment is a spark ignition type. The internal combustion engine is provided with an engine body 1. The engine body 1 includes a cylinder block 2 and cylinder head 4. Inside the cylinder block 2, pistons 3 are arranged. In the present invention, the space inside a cylinder surrounded by the crown surface of the piston and the cylinder head when the piston reaches compression top dead center and the space inside of the cylinder surrounded by the crown face of the piston and the cylinder head at any position will be called the "combustion chamber". The top face of the combustion chamber 5 is formed by the cylinder head 4, while the bottom face of the combustion chamber 5 is formed by the crown face of the piston 3.

A combustion chamber 5 is formed for each cylinder. Each combustion chamber 5 is connected to an engine intake passage and an engine exhaust passage. At the cylinder head 4, an intake port 7 and exhaust port 9 are formed. An intake valve 6 is arranged at an end of the intake port 7 and is formed to be able to open and close the engine intake passage which is communicated with the combustion chamber 5. An exhaust valve 8 is arranged at an end of the exhaust port 9 and is formed to be able to open and close the engine exhaust passage which is communicated with the combustion chamber 5. At the cylinder head 4, a spark plug 10 serving as an ignition device is fastened. The spark plug 10 is formed to ignite the fuel in the combustion chamber 5.

The internal combustion engine in the present embodiment is provided with a fuel injector 11 for feeding fuel to each combustion chamber 5. The fuel injector 11 in the present embodiment is arranged so as to inject fuel to the intake port 7. The fuel injector 11 is not limited to this. It is sufficient that it be arranged to be able to feed fuel to the combustion chamber 5. For example, the fuel injector may be arranged so as to directly inject fuel to the combustion chamber.

The fuel injector 11 is connected to a fuel tank 28 through an electronic control type variable discharge fuel pump 29. The fuel which is stored in the fuel tank 28 is supplied to the fuel injector 11 by the fuel pump 29.

The intake port 7 of each cylinder is connected through a corresponding intake runner 13 to a surge tank 14. The surge tank 14 is connected through an intake duct 15 and air flowmeter 16 to an air cleaner (not shown). At the intake duct 15, the air flowmeter 16 is arranged to detect the amount of intake air. At the inside of the intake duct 15, a throttle valve 18 which is driven by a step motor 17 is arranged. On the other hand, the exhaust port 9 of each cylinder is connected to a corresponding exhaust runner 19. The exhaust runner 19 is connected to a catalytic converter 21. The catalytic converter 21 in the present embodiment includes a three-way catalyst 20. The catalytic converter 21 is connected to an exhaust pipe 22.

The internal combustion engine in the present embodiment is provided with an electronic control unit 31. The electronic control unit 31 in the present embodiment includes a digital computer. The electronic control unit 31 includes components connected to each other through a bidirectional bus 32 such as a RAM (random access memory) 33, ROM (read only memory) 34, CPU (microprocessor) 35, input port 36, and output port 37.

The air flowmeter 16 generates an output voltage which is proportional to the amount of intake air which is taken into each combustion chamber 5. This output voltage is input to the input port 36 through a corresponding AD converter 38. An accelerator pedal 40 has a load sensor 41 connected to it. The load sensor 41 generates an output voltage which is proportional to the amount of depression of the accelerator pedal 40. This output voltage is input through a corresponding AD converter 38 to the input port 36.

A crank angle sensor 42 generates an output pulse every time a crankshaft for example turns by a predetermined angle. This output pulse is input to the input port 36. The output of the crank angle sensor 42 may be used to detect the engine speed. Further, the output of the crank angle sensor 42 may be used to detect the crank angle.

The output port 37 of the electronic control unit 31 is connected through corresponding drive circuits 39 to each fuel injector 11 and spark plug 10. The electronic control unit 31 in the present embodiment is formed so as to control fuel injection and control ignition. That is, the timing of injection of fuel and the amount of injection of fuel are controlled by the electronic control unit 31. Further the ignition timing of each spark plug 10 is controlled by the electronic control unit 31. Further, the output port 37 is connected through the corresponding drive circuits 39 to the step motor 17 for driving the throttle valve 18 and the fuel pump 29. These devices are controlled by the electronic control unit 31.

Figure 2:
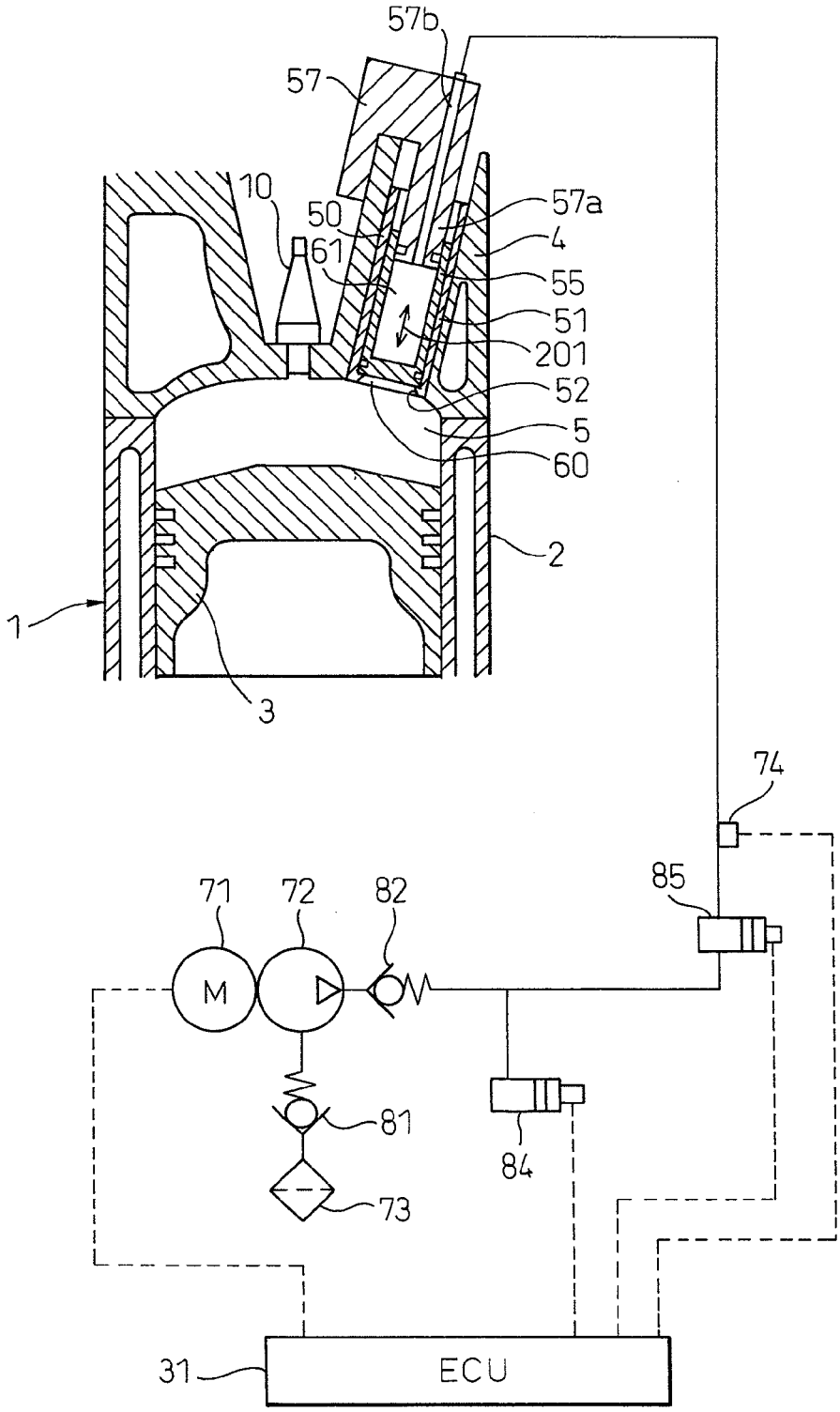
FIG. 2 is a schematic view of a variable volume device and gas feed device of an internal combustion engine in an embodiment.

FIG. 2 is a schematic cross-sectional view of a variable volume device and gas feed device of the internal combustion engine in the present embodiment. The internal combustion engine in the present embodiment has a plurality of cylinders. FIG. 2 is a cross-sectional view when cutting the engine body in the direction in which the plurality of cylinders are aligned.

The internal combustion engine in the present embodiment is provided with a combustion pressure control system which controls the pressure of each combustion chamber when the fuel is burned. The combustion pressure control system in the present embodiment is provided with a variable volume device by which the volume of the space communicated with a combustion chamber changes. The variable volume device includes a gas spring 50. A gas spring 50 is connected to each combustion chamber 5 in each cylinder. The internal combustion engine in the present embodiment has a sub chamber 60 as the space which is communicated with each combustion chamber 5. The variable volume device in the present embodiment changes the volume of the sub chamber 60.

A variable volume device in the present embodiment uses the pressure change of a combustion chamber 5, when the pressure of the combustion chamber 5 reaches the control pressure, as the drive source to change the volume of the sub chamber 60. That is, the variable volume device operates by the change of pressure of the combustion chamber 5. The control pressure in the present invention is a pressure of the combustion chamber when the variable volume device starts to operate. That is, this is the pressure of the combustion chamber when the movement member 55 starts to move. The variable volume device keeps the pressure of the combustion chamber 5 from becoming the pressure of occurrence of abnormal combustion or more. In the present embodiment, the control pressure is determined so that the pressure of the combustion chamber 5 does not become the pressure at which abnormal combustion occurs or more.

The abnormal combustion in the present invention, for example, includes combustion other than the state when an ignition device ignites the air-fuel mixture and the combustion successively propagates from the ignition point. Abnormal combustion includes, for example, the knocking phenomenon, detonation phenomenon, and preignition phenomenon. The knocking phenomenon includes the spark knock phenomenon. The spark knock phenomenon is the phenomenon where fuel is ignited in a spark device, the flame spreads centered from the ignition device, and the air-fuel mixture including unburned fuel at the position furthest from the ignition device self ignites. The air-fuel mixture at the position furthest from the ignition device is compressed by the combustion gas near the ignition device, becomes high temperature and high pressure, and self ignites. When the air-fuel mixture self ignites, a shock wave is generated.

The detonation phenomenon is the phenomenon where the air-fuel mixture ignites due to a shock wave passing through the high temperature, high pressure air-fuel mixture. This shock wave is, for example, generated due to the spark knock phenomenon. The preignition phenomenon is also called the "early ignition phenomenon". The preignition phenomenon is the phenomenon of metal at the tip of a spark plug or carbon sludge etc. deposited inside a combustion chamber being heated to a predetermined temperature or more and, in the state maintaining that, this part becoming the spark for ignition and burning of fuel before the ignition timing.

Figure 3:
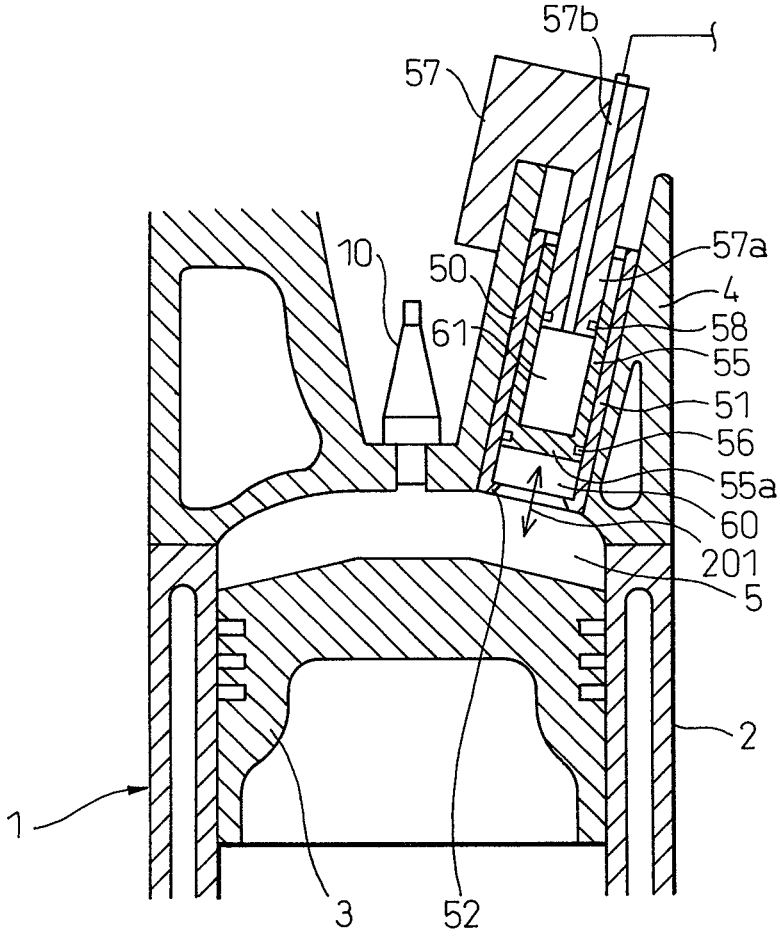
FIG. 3 is an enlarged schematic view of a variable volume device of an internal combustion engine in an embodiment.

FIG. 3 is an enlarged schematic cross-sectional view of the part of a variable volume device in the present embodiment. FIG. 3 shows the state when the movement member of the variable volume device moves. Referring to FIG. 2 and FIG. 3, the gas spring 50 of the variable volume device in the present embodiment is formed to have elasticity by sealing gas inside. The gas spring 50 includes a communication member 51 as a communication part which is arranged at the cylinder head 4. The communication part is formed in a tubular shape. The communication member 51 in the present embodiment is formed in a cylindrical shape. The communication member 51 has an open end at the side facing the combustion chamber 5. Further, communication member 51 has an open end at the opposite side to the side facing the combustion chamber 5.

The gas spring 50 includes a movement member 55 which is arranged at the inside of the communication member 51. The movement member 55 in the present embodiment is formed in a tubular shape to engage with the communication member 51. The movement member 55 has a piston part 55*a* which is formed at the end facing the combustion chamber 5. The movement member 55 is closed by the piston part 55*a* at the end at the side facing the combustion chamber 5. The movement member 55 has an open end at the opposite side to the side facing the combustion chamber 5. The movement member 55 is not fastened to the communication member 51. As shown by the arrow 201, it is formed so as to move in the axial direction of the communication member 51.

The gas spring 50 in the present embodiment includes a support member 57 serving as a support part which supports the movement member 55. The support member 57 in the present embodiment is arranged at the cylinder head 4. The support member 57 has a projecting part 57*a* which engages with the inside of the movement member 55. The projecting part 57*a* is formed into a rod shape. The projecting part 57*a* supports the movement member 55 in a movable manner.

The space at the inside of the communication member 51 is divided by the movement member 55. At the inside of the communication member 51, a sub chamber 60 is formed at the side facing the combustion chamber 5, while a gas chamber 61 is formed at the opposite side to the side facing the combustion chamber 5. The sub chamber 60 is a space surrounded by the wall surfaces of the communication member 51 and the piston part 55*a* of the movement member 55. The gas chamber 61 is a space surrounded by the movement member 55 and the projecting part 57*a*.

The gas chamber 61 of the gas spring 50 is charged with pressurized gas so that the movement member 55 starts to move when the pressure of the combustion chamber 5 reaches the desired control pressure. In the present embodiment, the gas chamber 61 is charged with air. The gas chamber 61 is formed in a sealable manner. When the gas chamber is sealed, the pressure of the gas chamber 61 causes the movement member 55 to be pushed.

The communication member 51 has an engagement part 52 which is formed at the end of the side facing the combustion chamber 5. The engagement part 52 engages with the movement member 55 at the end of the communication member 51. The state where the movement member 55 contacts the engagement part 52 is in a state with the movement member 55 seated at the inside of the communication member 51.

The gas spring 50 in the present embodiment includes a piston ring 56 which serves as a first sealing member and is arranged between the communication member 51 and the movement member 55. The piston ring 56 keeps the gas of the sub chamber 60 from leaking through the contact part of the communication member 51 and the movement member 55. The first sealing member in the present embodiment is arranged at the movement member 55, but the invention is not limited to this. It may also be arranged at the communication member 51.

The gas spring 50 in the present embodiment has an O-ring 58 serving as a second sealing member which is arranged between the movement member 55 and the projecting part 57*a* of the support member 57. The O-ring 58 keeps the gas of the gas chamber 61 from leaking through the parts where of the movement member 55 and the projecting part 57*a* contact. The O-ring 58 in the present embodiment is arranged at the projecting part 57*a*, but the invention is not limited to this. It may also be arranged at the movement member 55.

The internal combustion engine in the present embodiment is provided with a gas feed device which feeds gas to the gas spring of the variable volume device. The gas feed device in the present embodiment feeds air to the gas chamber 61 of the gas spring 50. The support member 57 is formed with a flow path 57*b* for feeding air to the gas chamber 61. The flow path 57*b* is connected to the gas feed device.

The gas feed device in the present embodiment includes a motor 71 and a compressor 72 which is driven by the motor 71. At the outlet of the compressor 72, a check valve 82 is arranged. The check valve 82 prevents the gas of the gas chamber 61 from flowing back and out. The compressor 72 is connected to a check valve 81 and filter 73. The filter 73 removes foreign matter from the air which is sucked into the compressor 72. The check valve 81 prevents air from flowing back from the compressor 72.

The gas feed device in the present embodiment has the function of changing the pressure of the gas chamber 61 of the gas spring 50. The gas feed device includes an air exhaust valve 84. The air exhaust valve 84 is arranged to enable the gas of the gas chamber 61 to be exhausted. The gas feed device includes a pressure regulator 85. The pressure regulator 85 regulates the pressure of the air which is fed to the gas chamber 61 by being operated. In the present embodiment, in the time period during which the movement member 55 is moving, the pressure regulator 85 is closed. By closing the pressure regulator 85, it is possible to shut the flow path connected to the gas chamber 61 and to seal the gas chamber 61.

The gas feed device in the present embodiment includes a pressure sensor 74 which serves as a gas chamber pressure detector which detects the pressure of the gas chamber 61 of the gas spring 50. The pressure sensor 74 in the present embodiment is arranged in the flow path connecting the compressor 72 and the communication member 51, but the invention is not limited to this. The gas chamber pressure detector may be arranged at any position enabling detection of the pressure of the gas chamber 61.

The gas feed device is controlled by the electronic control unit 31. In the present embodiment, the motor 71 is controlled by the electronic control unit 31. The air exhaust valve 84 and pressure regulator 85 in the present embodiment are controlled by the electronic control unit 31. The output of the pressure sensor 74 is input to the electronic control unit 31.

In the internal combustion engine in the present embodiment, air can be charged in the gas chamber 61 even if air leaks out from the gas chamber 51 during the operating period or stopping period. For example, by using the motor 71 to drive the compressor 72 and further opening the pressure regulator 85, it is possible to feed air to the gas chamber 61 of the gas spring 50.

Further, the gas feed device in present embodiment can raise the pressure of the gas chamber 61. Furthermore, the gas feed device in the present embodiment can exhaust the gas from the gas chamber 61 of the gas spring 50. By opening the pressure regulator 85 and the air exhaust valve 84, it is possible to lower the pressure of the gas chamber 61. In this way, by changing the pressure of the gas chamber 61, it is possible to change the control pressure. The gas feed device is not limited to this. Any device which can feed gas to the gas chamber of the gas spring may be employed.

Figure 4:
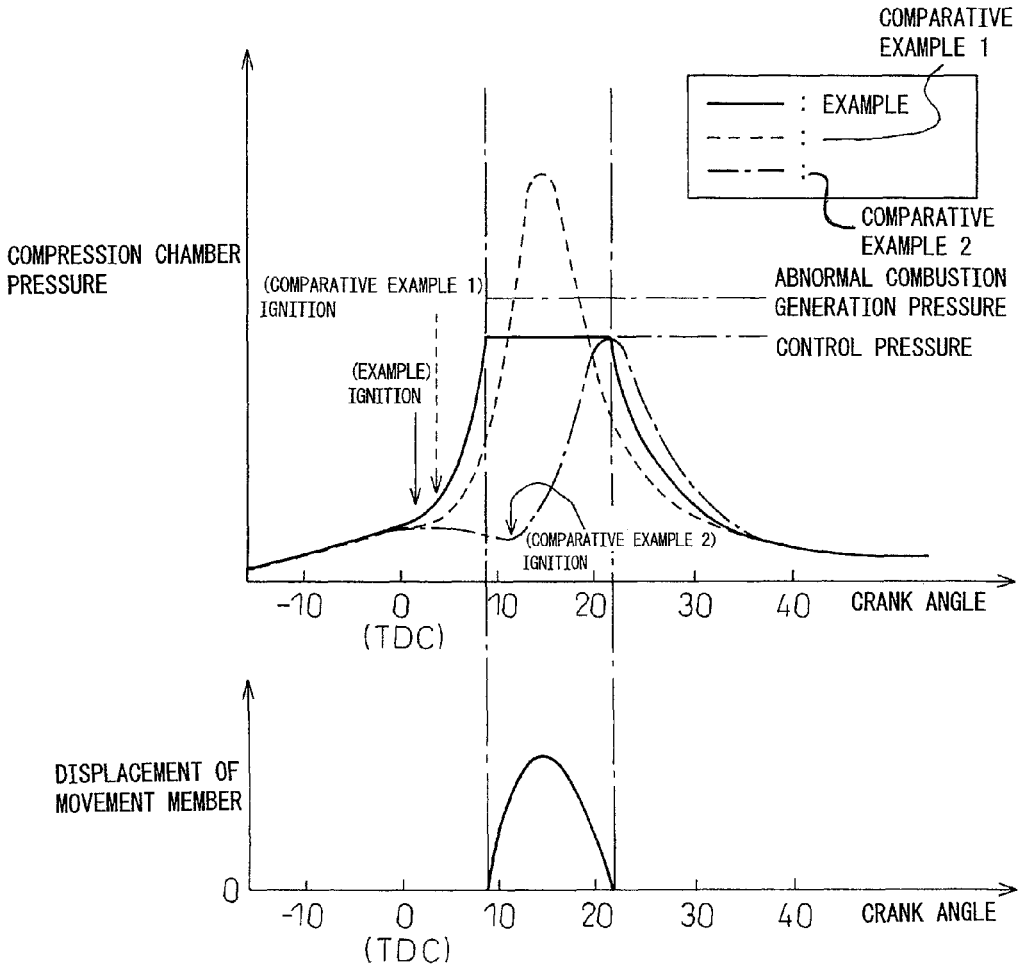
FIG. 4 is a graph which explains the operating state of an internal combustion engine which is provided with a variable volume device in an embodiment.

FIG. 4 is a graph of the pressure of the combustion chamber in the internal combustion engine of the present embodiment. The abscissa shows the crank angle, while the ordinate shows the pressure of the combustion chamber and the displacement of the movement member. FIG. 4 is a graph of the compression stroke and expansion stroke in the combustion cycle. The movement member 55 has zero displacement when seated at the bottom of the communication member 51. In the variable volume device in the present embodiment, the movement member 55 moves when the pressure of the combustion chamber reaches the control pressure during the time period from the compression stroke to the expansion stroke of the combustion cycle. As a result, the volume of the sub chamber 60 of the spring 50 becomes larger.

Referring to FIG. 2 to FIG. 4, at the start of the compression stroke, the movement member 55 is seated at the bottom of the communication member 51. At the compression stroke, the piston 3 rises and therefore the pressure of the combustion chamber 5 rises. Here, the gas chamber 61 has gas of a pressure corresponding to the control pressure sealed into it, so the movement member 55 is maintained in the seated state until the pressure of the combustion chamber 5 becomes the control pressure.

In the embodiment shown in FIG. 4, the fuel is ignited after the crank angle becomes slightly after 0° (TDC). Due to the ignition, the pressure of the combustion chamber 5 rapidly rises. When the pressure of the combustion chamber 5 reaches the control pressure, the movement member 55 starts to move. If the air-fuel mixture burns more, the gas chamber 61 is compressed and the displacement of the movement member 55 becomes greater. The volume of the sub chamber 60 becomes larger. For this reason, the pressure of the combustion chamber 5 and sub chamber 60 is kept from rising. In the example shown in FIG. 4, the pressure of the combustion chamber is held substantially constant. Note that, strictly speaking, due to the movement of the movement member 55, the pressure inside of the gas chamber 61 rises, so the pressure of the combustion chamber 5 also rises.

In the combustion chamber, if the fuel burns further, the displacement of the movement member 55 becomes maximum, then becomes smaller. The pressure of the gas chamber 61 is reduced and the displacement of the movement member 55 returns to zero. That is, the movement member 55 returns until the seated position. When the pressure of the combustion chamber 5 becomes less than the control pressure, the pressure of the combustion chamber 5 is reduced along with the advance of the crank angle.

In this way, the combustion pressure control device in the present embodiment suppresses the rise of the pressure of the combustion chamber when the pressure of the combustion chamber 5 reaches the control pressure and can control the pressure of the combustion chamber to not become more than the pressure at which abnormal combustion occurs.

FIG. 4 shows a graph of the pressures of the combustion chambers of Comparative Example 1 and Comparative Example 2. Comparative Example 1 and Comparative Example 2 are examples of internal combustion engines not having variable volume devices of the present embodiment. An internal combustion engine fluctuates in the pressure of the combustion chamber depending on the ignition timing. An internal combustion engine has an ignition timing θmax where the output torque becomes maximum. Comparative Example 1 is a graph of the time of ignition at the ignition timing θmax. By ignition at the ignition timing where the output torque becomes maximum, the pressure of the combustion chamber becomes high and the heat efficiency becomes best. In this regard, as shown in Comparative Example 1, if the ignition timing is advanced, the pressure of the combustion chamber becomes higher than the pressure causing abnormal combustion. The graph of Comparative Example 1 assumes that no abnormal combustion has occurred. On the other hand, in an actual internal combustion engine, the ignition timing is retarded so that the maximum pressure (Pmax) of the combustion chamber becomes smaller than the pressure causing abnormal combustion.

In the internal combustion engine of Comparative Example 2, to avoid abnormal combustion, ignition is performed at an ignition timing retarded from the timing at which the output torque becomes maximum. If retarding the ignition timing, the maximum pressure of the combustion chamber becomes smaller than the case of ignition by the ignition timing at which the output torque becomes maximum.

The internal combustion engine in the present embodiment can perform combustion by a pressure of the combustion chamber less than the pressure at which abnormal combustion occurs. Even if advancing the ignition timing, it is possible to suppress occurrence of abnormal combustion. In particular, it is possible to suppress abnormal combustion even in an engine in which the compression ratio is high. Furthermore, it is possible to make the time during which the pressure of the combustion chamber is high longer. For this reason, the heat efficiency is improved from the internal combustion engine with the delayed ignition timing of Comparative Example 2, so the output torque can be increased. Further, it is possible to reduce the amount of fuel consumption.

In the variable volume device of the present embodiment, when the movement member 55 moves, the gas chamber 61 is sealed. In the present embodiment, the O-ring 58 can be used to keep gas from leaking from the gas chamber 61. In this regard, the gas chamber 61 is a high pressure and sometimes gas leaks from the gas chamber 61. For example, during the time period during which the movement member 55 moves, the O-ring 58 and the movement member 55 slide, so sometimes the gas of the gas chamber 61 leaks. In the present embodiment, the movement member 55 is formed into a tubular shape, and the end of the movement member 55 at the opposite side to the side facing the combustion chamber 5 is open. The end of the movement member 55 at the opposite side to the side facing the combustion chamber 5 is communicated with the atmosphere. For this reason, even if air leaks from the gas chamber 61, the leaked air can be discharged into the atmosphere. That is, even if air leaks from the gas chamber 61, the leaked gas can be kept from flowing into the combustion chamber 5.

For example, if the air which leaks out from the gas chamber 61 flows into the combustion chamber 5, when the gas which is sealed in the gas spring 50 is air, the air-fuel ratio when the air-fuel mixture is burned becomes larger. That is, the air-fuel ratio at the time of combustion deviates to the lean side. When controlling the air-fuel ratio at the time of combustion to the desired value, to correct the air-fuel ratio at the time of combustion, the amount of fuel which is fed to the combustion chamber increases. For this reason, the torque which is output will end up becoming larger. Further, if the amount of air which leaks from the gas chamber 61 to the combustion chamber 5 is unstable, the torque which is output for each combustion cycle will fluctuate. Further, if the amount of air which leaks from the gas chamber 61 to the combustion chamber 5 differs with each cylinder, the torque which is output will differ with each cylinder.

Further, if the air-fuel ratio at the time of combustion fluctuates, the mixed ratio of the unburned fuel and air in the exhaust which is discharged from a combustion chamber 5 (air-fuel ratio of exhaust) will end up deviating from the desired value and the exhaust purification system will not be able to sufficiently purify the exhaust. For example, sometimes it will not be possible to make the air-fuel ratio of the exhaust which flows into the three-way catalyst substantially the stoichiometric air-fuel ratio and the properties of the discharged exhaust will deteriorate.

When the gas which is charged in the gas spring 50 is nitrogen, carbon dioxide, argon, or another inert gas, if the inert gas of the gas chamber 61 flows into the combustion chamber 5, the combustion becomes slower. Further, in the same way as when the gas which is sealed in the gas spring is air, sometimes torque fluctuations will occur with each combustion cycle or the torque which is output from the different cylinders will vary.

In this way, if gas leaks from a gas chamber toward a combustion chamber, there is the problem that the operating state of the internal combustion engine will deteriorate. However, the variable volume device in the present embodiment keeps the leaked gas from flowing into the combustion chamber even if the gas leaks from the gas chamber, so it is possible to keep the operating state of the internal combustion engine from being adversely affected.

The variable volume device in the present embodiment is formed so that the gas which is leaked from the gas chamber is discharged into the atmosphere, but the invention is not limited to this. It may be formed so that the gas which is leaked from the gas chamber is discharged to the outside of the cylinder head. For example, when charging the gas chamber with inert gas, it is also possible to recover the gas leaked from the gas chamber and feed it to the gas feed device.

Further, in the variable volume device, the gas of the sub chamber 60 sometimes leaks through the contact parts of the communication member 51 and the movement member 55. In the variable volume device in the present embodiment, the end at the opposite side to the side facing the combustion chamber 5 of the communication member 51 is open. The end at the opposite side to the side facing the combustion chamber 5 of the communication member 51 is opened to the atmosphere. For this reason, even when the gas of the sub chamber 60 leaks, the leaked gas is discharged to the outside of the cylinder head and so the gas of the sub chamber 60 can be kept from flowing into the gas chamber 61. The variable volume device in the present embodiment makes it possible to keep gas from flowing from the sub chamber 60 to the gas chamber 61 and having a detrimental effect on the control pressure.

Referring to FIG. 3, the piston ring 56 serving as the first sealing member in the present embodiment is preferably formed to have a higher heat resistance than the O-ring 58 serving as the second sealing member. The first sealing member has the function of sealing the high temperature gas which results from burning in the combustion chamber 5. For this reason, the first sealing member preferably has heat resistance. On the other hand, the second sealing member has the function of sealing in the gas of the gas chamber, so it is possible to employ a sealing member with a lower heat resistance than the first sealing member.

Further, the O-ring 58 used as the second sealing member in the present embodiment is preferably formed so that the piston ring 56 serving as the first sealing member becomes higher in sealing ability. The gas chamber 61 is charged with high pressure gas. If the sealing ability of the second sealing member is low, a large amount of gas will leak from the gas chamber 61, so the work of the gas feed device increases. Further, when the internal combustion engine is not provided with a gas feed device, if the sealing ability of the second sealing member is low, the pressure of the gas chamber ends up greatly falling. As a result, the control pressure ends up greatly falling. For this reason, the second sealing member preferably has a high sealing ability. On the other hand, the first sealing member has the function of keeping the gas from leaking from the temporarily higher pressure sub chamber, so it is possible to employ a sealing member with a lower sealing ability than the second sealing member.

The first sealing member is preferably formed by tool steel, spring steel, or another material which has heat resistance.

Further, it need not have as large a sealing ability as the second sealing member, so, for example, it is possible to employ a C-ring which has a fitting portion with C-planar shape. As opposed to this, the second sealing member preferably has a high sealing ability. For this reason, it is preferable to employ an O-ring with an O-planar shape. Further, the second sealing member may have a heat resistance smaller than the first sealing member. For this reason, the second sealing member, for example, can be formed by fluororubber or silicone rubber etc. Note that, first sealing member and second sealing member are not limited to these embodiments. The sealing members employed may be any sealing members which have the required sealing ability without heat damage.

The internal combustion engine in the present embodiment is provided with a gas feed device, but the invention is not limited to this. A gas feed device need not be arranged. That is, the gas chamber may also be constantly sealed.

In the above drawings, the same or corresponding parts are assigned the same reference signs. Note that the above embodiments are illustrations and do not limit the invention. Further, in the embodiments, the changes shown in the claims are included.

REFERENCE SIGNS LIST

1 engine body
4 cylinder head
5 combustion chamber
21 catalytic converter
22 exhaust pipe
31 electronic control unit
50 gas spring
51 communication member
52 engagement part
55 movement member
56 piston ring
57 support member
57*a* projecting part
58 O-ring
60 sub chamber
61 gas chamber
72 compressor
74 pressure sensor
84 air exhaust valve
85 pressure regulator

The invention claimed is:

1. An internal combustion engine provided with a sub chamber which is communicated with a combustion chamber and a variable volume device which changes a volume of the sub chamber, wherein the variable volume device includes a communication part arranged at a cylinder head including a crown face of the combustion chamber and formed into a tubular shape so as to communicate with the combustion chamber, a movement member which is formed in a tubular shape so as to engage with the inside of the communication part and which has a closed end at the side facing the combustion chamber, and a support part which has a projecting part which engages with the inside of the movement member and which supports the movement member in a movable manner, the movement member divides the space at the inside of the communication part whereby a sub chamber is formed at the side facing the combustion chamber and a sealable gas chamber is formed at the opposite side to the side facing the combustion chamber, when the pressure of the combustion chamber reaches a control pressure, the change in pressure of the combustion chamber is used as a drive source so that the movement member moves and thereby the volume of the sub chamber becomes larger, and the movement member has an open end at the opposite side to the side facing the combustion chamber and discharges gas of the gas chamber which leaks from the parts where the movement member and the projecting part contact to the outside of the cylinder head.

2. An internal combustion engine as set forth in claim 1 wherein the variable volume device includes a first sealing member which is arranged between the communication part and the movement member and a second sealing member which is arranged between the movement member and the projecting part, the second sealing member formed to have a higher sealing ability than the first sealing member.

3. An internal combustion engine as set forth in claim 1 wherein the variable volume device includes a first sealing member which is arranged between the communication part and the movement member and a second sealing member which is arranged between the movement member and the projecting part, the first sealing member formed to have a higher heat resistance than the second sealing member.

* * * * *